United States Patent [19]

Luchi

[11] Patent Number: 4,674,301

[45] Date of Patent: Jun. 23, 1987

[54] COMPOUND NEEDLE AND KNITTING MACHINE

[75] Inventor: Luciano Luchi, Tavernuzze Impruneta, Italy

[73] Assignee: Officine Savio SpA, Pordenone, Italy

[21] Appl. No.: 620,969

[22] Filed: Jun. 15, 1984

[30] Foreign Application Priority Data

Jun. 27, 1983 [IT] Italy ..... 83407 A/83

[51] Int. Cl.[4] ..... D04B 9/38; D04B 35/06

[52] U.S. Cl. ..... 66/13; 66/120

[58] Field of Search ..... 66/13, 62, 120

[56] References Cited

U.S. PATENT DOCUMENTS 1,391,033 9/1921 Wilcomb ..... 66/120

3,535,892 10/1970 Schmidt et al. ..... 66/13

4,109,490 8/1978 Bosch ..... 66/120

FOREIGN PATENT DOCUMENTS 2245731 3/1974 Fed. Rep. of Germany ..... 66/120

*Primary Examiner*—Wm. Carter Reynolds

[57] ABSTRACT

A process for operating and controlling compound needles that have reciprocal travel of the needle and slider restricted by abutment surfaces where the needle is lifted high enough to engage yarn but less than the travel of the needle and slider and the descent of the needle. Before the needle descends, the needle is lifted selectively to bring the upper end of the slider above the plane of knock-over of the sinkers through the action of abutment between the needle and slider. Needle descent takes place along at least two successive slopes in a track with different descent inclinations, the second slope being the steeper. Slider recall by the needle begins before the needle is brought down again by the second slope. Improved stitch-forming cams to permit compound needles to operate in accordance with the foregoing process are disclosed also.

20 Claims, 12 Drawing Figures

COMPOUND NEEDLE AND KNITTING MACHINE

Figure 1B:
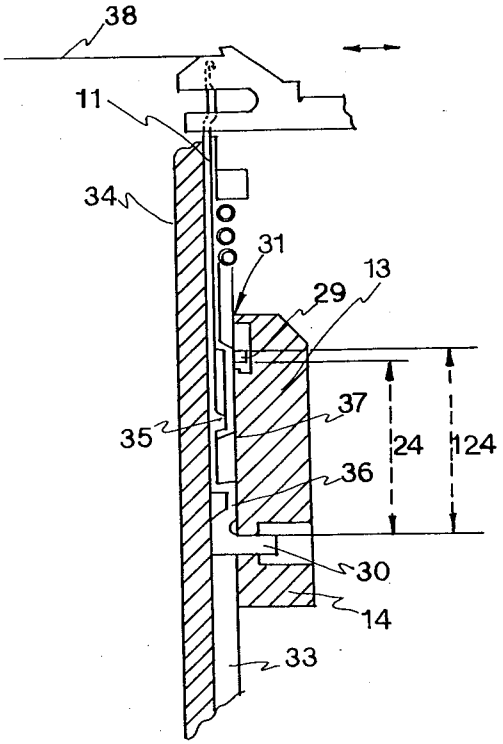

This invention concerns a procedure to operate and control compound needles.

The invention also concerns improvements to stitch-forming cams in cylindrical knitting machines; to be more exact, the invention concerns improvements applied to stitch-forming cams and suitable for enabling compound needles to be operated and controlled according to the procedure.

Moreover, the invention concerns stitch-forming cams in circular knitting machines which employ the foregoing improvements.

In particular the invention refers to cams positioned on the cylinder of circular knitting machines.

To be more specific, the invention refers to high-speed or very high-speed circular knitting machines, such as are suitable for working at 800–1000 revolutions per minute or more with 4" cylinders or the like.

It is known that circular knitting machines entail dynamic problems regarding movement of the needles, the problems involving very heavy stresses in the needles themselves.

Compound needles of various types and conformations or indeed compound needles of the types disclosed in the state of the art given hereinafter are known.

Various methods for controlling and operating these compound needles by means of cams are known, as also are various arrangements of cams intended to perform such operating and controlling.

For instance, GB No. 1,571,017 (DE-A-No. 2.705.605) in the name of TIPPSA is known which proposes compound needles and a lay-out of cams to control these needles.

This patent does not envisage the possibility of working with tuck stitches nor does it avoid the throwing of the slider element in both directions by the needle element when the machine is working at high speed.

DE-A-No. 2.320.789 in the name of TERROT is also known and discloses compound needles actuated by cams. The nature of the system of cams employed, and in particular, the steepness of their tracks and the absence of rounded corners make this invention unsuitable for high speeds. Tracks to control the travel of the slider element are shown.

DE-A-No. 2.908.022 (TERROT) concerns mainly the formation of compound needles. In this invention too the control cams seem unsuitable for use at high speeds.

FR No. 1.573.866 (MORAT) discloses a circular knitting machine with compound needles; in this machine both the needle and the slider are controlled by cams.

GB No. 2,020,705 A is known and discloses a circular knitting machine that employs compound needles. This invention dwells in particular on the needles used and on the methods for forming stitches but does not provide information in depth about the structure of the outfit of cams intended to guide the needles.

The compound needles employed consist, moreover, of three parts, one of which is a closure part that cannot move axially to the cylinder and that controls the travel of the slider element.

The structure of the needles is complicated and entails considerable sizes and frictions, thus rendering the invention unsuitable for use with high and very high speeds.

U.S. Pat. No. 3,828,582 discloses compound needles in which the slider element has a lateral controlling curvature, and also discloses an arrangement of cams intended to operate and control the compound needles.

Problems linked to compound needles are normally well known. These problems are already obvious in traditional compound needles at the restricted working speeds now known, such working speeds being restricted either as regards linear displacement or as regards lengthwise displacement.

It is also known that various compound needles have been specifically designed essentially for linear machines, in which centrifugal force is practically non-existent, or for large diameter circular machines, in which centrifugal force is of a low value owing to their low speed.

In high-speed and very high-speed cylindrical machines all the stresses are strongly displayed and are translated into an exceptional dynamic pressure on every component of a compound needle.

The present assignee has therefore found it necessary to make possible a considerable life for the compound needles designed and embodied by themselves and have thus had to review in depth the generating concepts of the abutment cams, the purpose of this being to make the traditional abutment cams, and also the abutment cams patented and protected by the assignee, compatible with employment of new compound needles.

One of the most evident problems regarding the application of compound needles to high-speed and very high-speed circular knitting machines is linked to the constant control of the position of the slider element in relation to the needle element.

A first known method for controlling this position is to embody a curvature of the slider so as to create a given friction between the slider and the needle bed trick.

This curvature, however, above all during inversions of lengthwise movement, is not enough to control the slider actively in relation to the needle element.

It therefore became necessary to tackle the problem of how to be able to control the position of the slider in relation to the needle continuously and at all transient times.

In fact it is desirable that the slider should not go beyond its theoretical position and should not undergo dynamic stresses greater than those permissible, or at any rate stresses which might reduce its life considerably.

To obviate this, the assignee has not only had to review all the geometric components of the cams and counter-cams but have also had to re-think the abutment cam completely. The purpose of this is to make compatible this new embodiment of compound needles and thus to extend the already great possibilities of perfect control and rationalization of the formation of stitches by abutment cams and in particular by the abutment cams designed, tested and, at due times, patented by the present assignee itself.

According to the invention the travel of the needle in relation to the slider is arranged in such a way that the distance between the upper point of the needle lifter means positioned downstream from the abutment cams and the lower position of the counter-cam cooperating with the abutment cam is such as to be substantially the same as the reciprocal travel as between the needle and the slider.

Two abutment positions are located as between the needle element and the slider element.

The possible reciprocal travel of these elements is greater than, or the same as, the amount by which the needle has to be lifted so as to engage the yarn. In this way a tuck stitch is obtained.

Furthermore, the assignee has found that the cam which abuts against the needles and which normally comprises in its lower track a first gentle descending approach slope and a final very steep abutment slope has to be such that the beginning of the steep abutment slope will lie in a position lower than the upper position of the needle butt leaving the tuck stitch leveller track formed on the needle lifter means.

In this way the needle butt will meet the gentle descent slope, which is less inclined and therefore causes less stress, before being subjected to a sudden sharp descent.

The sharp descent slope can also be rounded progressively to join the gentle descent slope located immediately upstream and can be progressively and variably inclined over an ample tract.

In such a case it has been found by tests that the beginning of the steep slope can be deemed to be the neighborhood of the point where the inclination of the slope exceeds 20°.

Hereinafter the words "transition point" shall mean not only that point but also the neighborhood of that point.

Moreover, it has been found that, so as to ensure a long working life for the compound needle, it is necessary to be able to ensure a constant control of the position of the slider in relation to the needle.

This is necessary above all after a given period of working during which the friction and consequent reciprocal wear have made less rigid the control of the position of the slider in the trick by means of friction.

To obviate this drawback, the assignee has envisaged as cooperating with the stitch-forming cam at least one cam to level the upper position of the slider leaving the ascent means which lift the needle.

Furthermore, it has been found that the dynamic stresses applied to the slider during abutment are such as to have a considerable effect on the life of the slider itself.

To prevent this, there has been embodied an upper sliding surface for the butt of the slider, this surface being coordinated with the lower position of abutment of the needles.

In particular there has been embodied an advantageous upper conformation of the abutment cam such as to be able to discharge resiliently the dynamic tensions produced in the slider itself.

According to this embodiment a deceleration track is envisaged on the upper flank of the needle-abutment cam in a position coordinated with the bottom dead center point of that cam.

This deceleration track has its lowest point lying at such a distance from the bottom dead center point as is substantially the same as, or very little less than, the inner distance between the two butts in their positions spaced farthest apart, that is, their positions when the compound needle is closed.

The inclusion of this deceleration track has the effect that, when the needle reaches the bottom dead center point, the slider has available a further given descent travel which allows it to absorb dynamically the forces acting upon it.

Moreover, it has been found that such dynamic absorption is advantageous if the steep descent slope of the needle lies at an angle of 8–20° to the descent slope of the slider.

This means that the descent slope of the deceleration track delays the descent of the slider and thus absorbs a given dynamic component of the slider gradually.

Immediately afterwards the slider butt meets a reascent slope, which has the purpose of keeping the relative position of the slider unchanged even when the stem of the needle is lifted on the reascent track, thus avoiding an impact between the needle and the slider during ascent.

Moreover, so as to avoid a sharp recall of the slider by the needle when the latter descends, such recall has to take place before the needle butt meets the steep descent slope.

This is obtained by arranging that the distance between the profile for the upper levelling of the position of the slider and the beginning of the steep slope is greater than the maximum distance between the inside of the needle butt and the outside of the slider butt as permitted by the reciprocal needle/slider travel.

In this way the recall of the slider by the needle takes place advantageously before the needle itself is lowered sharply by the steep descent slope.

The result is a more gentle recall of the slider, which is also already in contact with the needle when the latter is engaged by the steep descent slope, thereby obviating an impact between the needle and slider in correspondence with that slope.

According to a variant it is possible to envisage means to launch the slider, such means having the function of actuating the descent of the slider actively before the latter is engaged by the descending needle. Such launching means can be embodied as an additional track, for instance, which acts on the slider butt.

This invention is therefore obtained with a procedure to operate and control compound needles of a type having a reciprocal travel of needle and slider restricted by appropriate abutment surfaces on a needle and slider, which procedure comprises the lifting of the needle by an amount sufficient to engage the yarn but less than the reciprocal needle/slider travel, and also the descent of the needle and is characterized by comprising also, before such descent of the needle, the selective lifting of the needle by an amount such as to bring, through the action of abutment between the needle and slider, the upper end of the slider above the plane of knock-over of the sinkers, the descent of the needle taking place along at least two successive slopes in a track with different descent inclinations of which the second slope is steeper, the recall of the slider by the needle beginning before the needle itself is brought down again by the second slope.

The invention is also obtained with improvements to stitch-forming cams in circular knitting machines, the improvements being suitable for enabling compound needles to be operated and controlled according to the foregoing procedure, by which improvements the cams comprise at least track means for reascent of the needles, abutment cam means including gentle slope means for descent of the needles and steep abutment slope means, counter-cam means to establish the bottom dead center point for the needles, upper track means which control the travel of the slider butt from below, and an upper leveller cam means which controls the travel of the slider butt from above, the improvements being characterized by comprising track means to decelerate the slider butt in a position coordinated with at least the end part of the steep slope that abuts against the needle, the track means being obtained in cooperation with the upper track means, the inclination of the controlled descent slope of the deceleration track being less than the inclination of the steep slope that abuts against the needle.

The invention is also embodied with stitch-forming cams in circular knitting machines to carry out the procedure described above, which cams are characterized by adopting the above improvements.

Figure 1A:
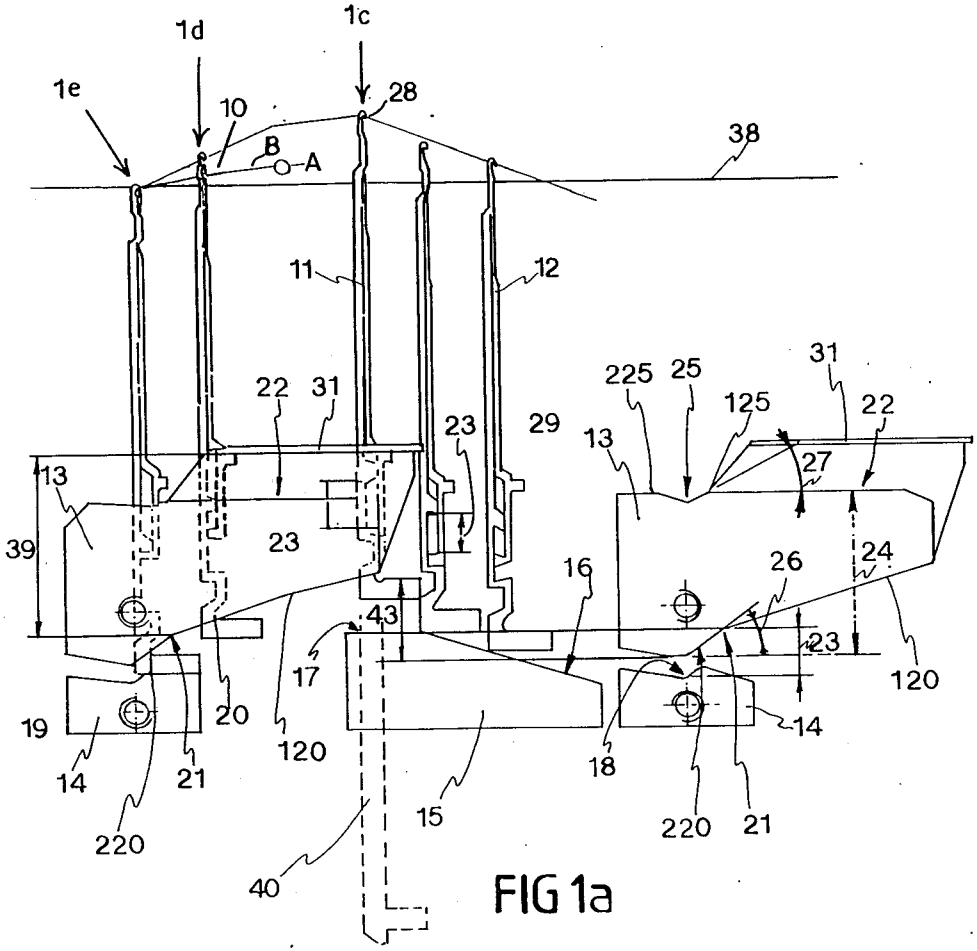
Figure 1E:
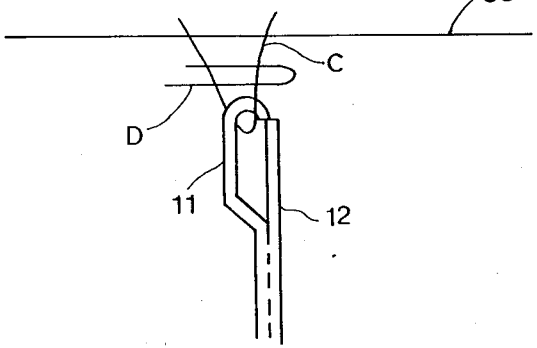
Figure 1D:
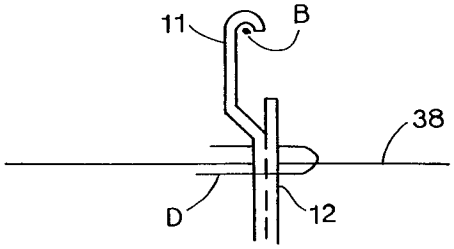
Figure 1C:
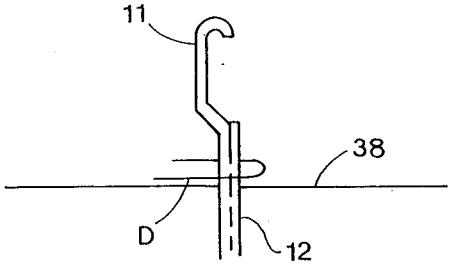
Figure 1G:
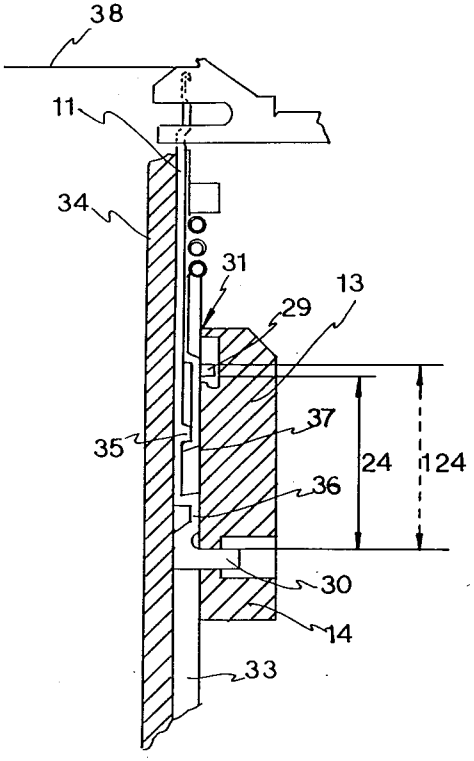
Figure 1F:
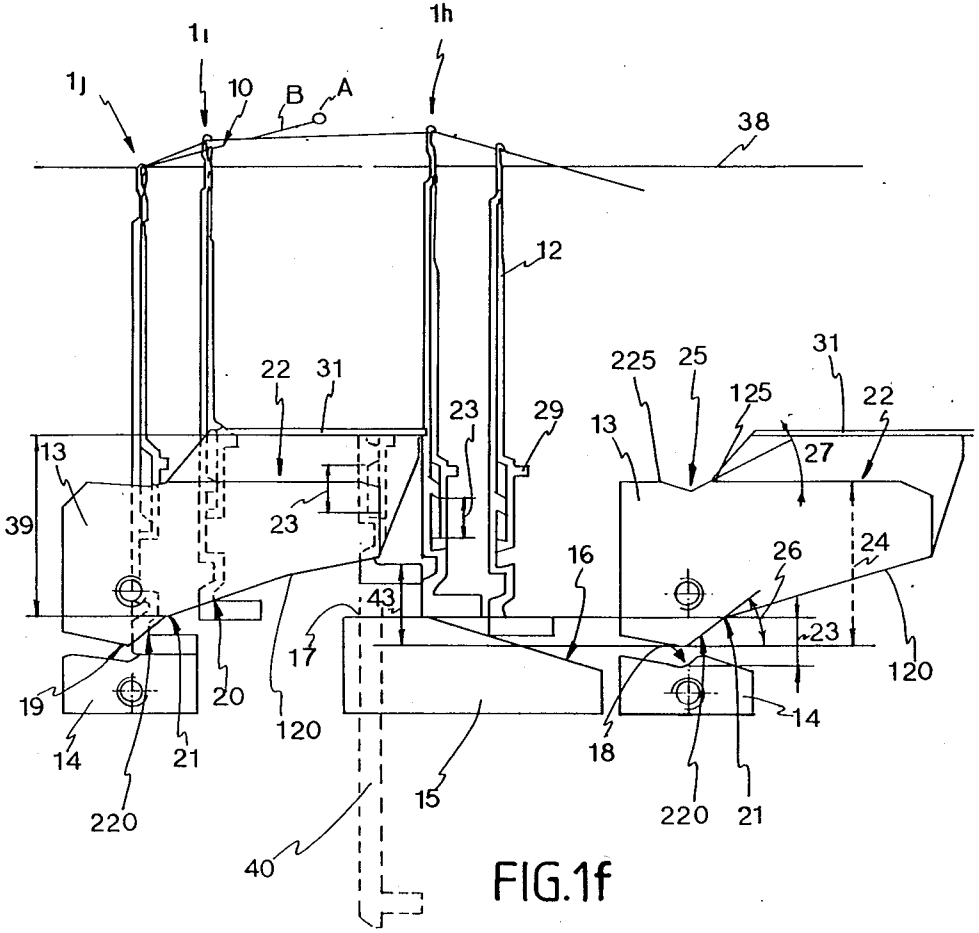
Figure 1J:
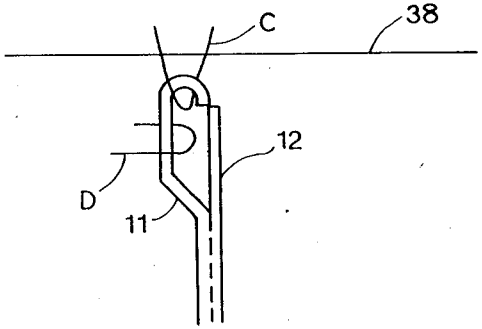
Figure 1I:
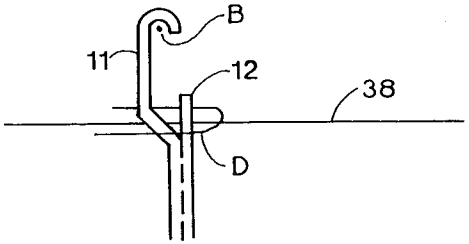
Figure 1H:
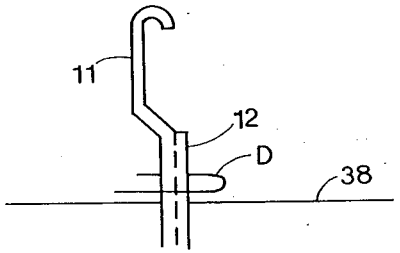
Figure 2B:
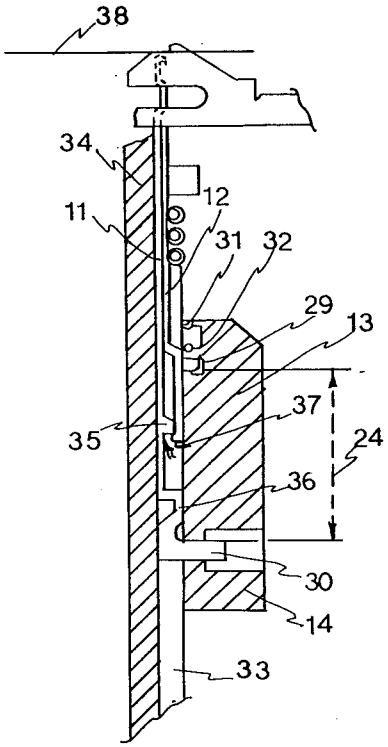
Figure 2A:
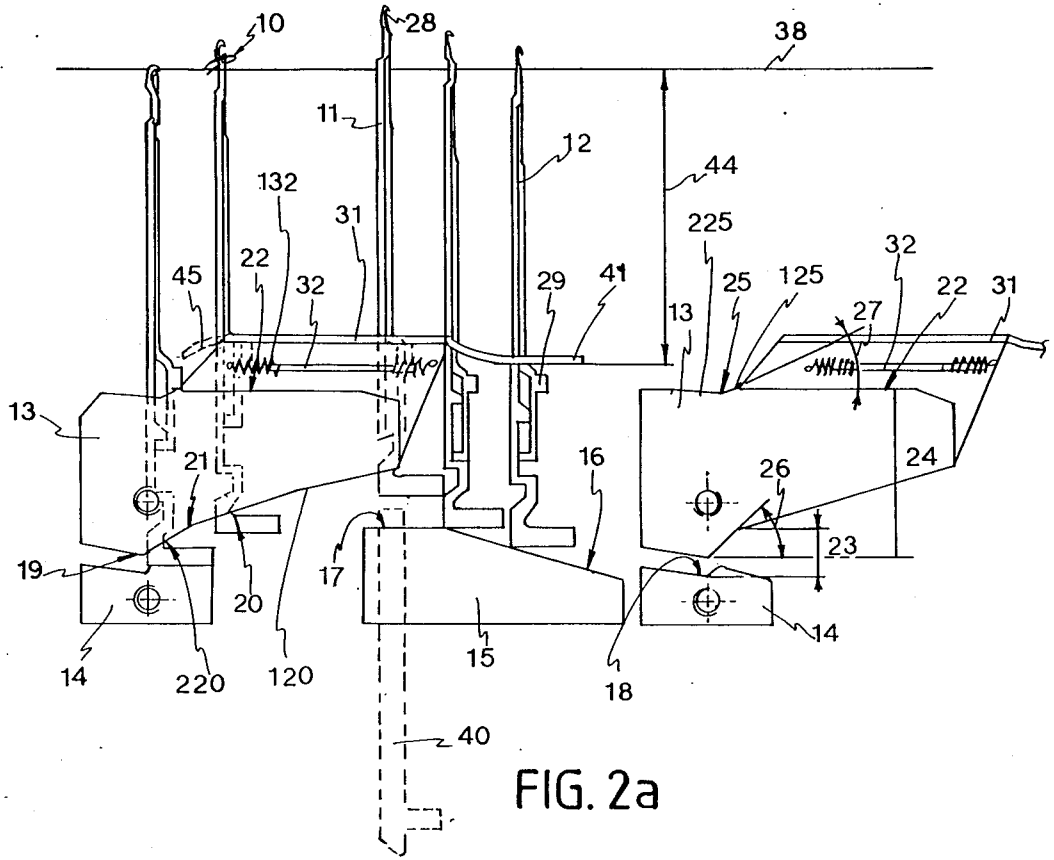

There is described hereinafter as a non-restrictive example two preferred embodiments of the invention with the help of the attached figures, in which:

FIGS. 1*a* and 1*b* show a first preferred embodiment of the invention;

FIGS. 1*c* to 1*e* show various aspects of the needle to feed relationship when forming a normal jersey stitch in accordance with the present invention;

FIGS. 1*f* to 1*j* show various aspects of the invention when forming a tuck stitch in accordance with the present invention where FIGS. 1*h* to 1*j* depict the needle to feed relationship;

FIGS. 2*a* and 2*b* give a variant of the invention.

In the figures a compound needle 10 with a hook 28 has to cooperate with the plane of the knock-over of sinkers 38 according to well-determined geometric functions so as to be able to form the desired stitches with the form and characteristics required.

According to the invention the compound needle 10 cooperates with and on the periphery of a cylinder 34 in normal needle bed tricks 33 as used with normal needles.

This means that the overall dimensions of the compound needle of the invention remain within the normal dimensions of a traditional needle.

In this way it is possible to work with a compound needle or normal needle in circular knitting machines, depending on the type of stitch, without any need to replace the cylinder itself.

FIGS. 1*a* and 1*b* show the path of a needle 11, a butt 30 of which is firstly engaged by a lifting track 16 present on the top of needle lifter means 15.

After the lifting track 16, a straight track 17 corresponding to a tuck stitch is present in the needle lifter means 15.

A pusher or selector means 40 is included in correspondence with the straight track 17 and has the task of lifting or not lifting the butt 30 above the tuck stitch track 17, depending on the type of stitch to be produced.

The invention advantageously envisages the track 17 plus the thickness of the butt 30 as being higher than a transition point 21.

It has been found by tests that with such an arrangement the contact of the butt 30 with a track 20 takes place before the transition point 21, so that the beginning of the return of the needle 11 occurs on a gentle descent slope 120 and is therefore smoother.

The needle 11 continues its trajectory, leaving the lifting track 16 and engaging the descent track 20 in coincidence with the gentle slope 120, which has a not very steep inclination.

The slope 120 may possibly develop, as shown, in two or more rounded tracts so as not to speed up the needle 11 too much and so as not to transmit excessive stresses to the needle 11; or else the slope 120 may have a gradually variable inclination.

Immediately afterwards the descent track 20 has a steep slope 220 to abut against the needle 11.

After the slope 220 the needle 11, having passed a bottom dead center point 18 located on a counter-cam 14, is lifted once again and sent along a successive ascent track 16 on successive needle lifter means 15.

The guiding of the butt 30 of the needle 11 is obtained with the above tracks. Instead, the slider 12 is guided by means of a projection 37 which cooperates alternatively with an upper protrusion 35 and lower protrusion 36 jutting from the needle 11.

The protrusions 35–36 abut alternatively against the projection 37 of the slider 12 and regulate its two-and-fro travel.

Furthermore, so as to avoid excessive movements of the slider 12 and to ensure that it is controlled during its closure phase, namely when the slider is in the position where the butt 30 of the needle 11 engages the gentle slope 120 of the descent track 20, the slider 12 itself is provided with a butt 29.

This butt 29 is controlled from below by a track 22 located on the upper flank of an abutment cam 13, and its travel is restricted from above by an upper leveller cam 31 having a straight development.

The butt 29 of the slider 12 meets the upper leveller cam 31, so that the upper position of the slider 12 is controlled during descent of the needle 11.

At a given point on its descent, the needle 11 engages the projection 37 of the slider 12 with its upper protrusion 35. This causes the slider 12 to descend together with the needle 11.

As soon as the needle 11 reaches the bottom dead center point 18, that is to say, when it coincides with an inversion point 19 of the lower track 20 comprised on the abutment cam 13, if the upper track 22 of the abutment cam 13 were flat, the butt 29 of the slider 12 would collide violently against the track 22. In the long term this would create serious problems for the strength of the slider 12 itself.

A deceleration track 25 is envisaged for the purpose of eliminating this shortcoming by braking the impact of the butt 29 against the track 22.

The track 25 has a controlled descent slope 125 with an inclination 27 and a controlled reascent slope 225.

The deceleration track 25 has the purpose of braking the travel of the slider 12 and of causing a somewhat gentle inversion of the movement of the slider 12 simultaneously with inversion of the movement of the needle 11. In this way a sudden deceleration of the slider 12 is obviated.

In the figures, 24 is the distance between the lower edge of the butt 29 and the upper edge of the butt 30. This distance 24 is substantially the same as, or a little greater than, the distance between the bottom of the track 25 and the lower end 19 of the track 220.

When the butt 30 is at the bottom dead center point 18, the butt 29 and therefore the slider 12 have still available a given track of travel so that their motion can be braked within the deceleration track 25. This is advantageous for the working life of the slider 12 and needle 11.

So as to carry out this deceleration as effectively as possible, it has been found that the inclination 27 of the track 125 should be less than the inclination 26 of the steep slope 220 that abuts against the needle 11.

It has been found in particular that the greatest efficiency of deceleration is obtained when the difference between the two inclinations 26 and 27 is between 8° and 20°.

Immediately afterwards and coinciding with the reascent of the needle 11 caused by the counter-cam 14, there is comprised in the track 25 a reascent tract 225, which permits the slider 12 to reascend gently and to keep its relative position so as to avoid a collision with the needle 11 moving on the profile 17.

The figures also show the greatest inner distance 23 between the projection 37 on the slider 12 and the upper protrusion 35 on the needle 11. This distance 23 is therefore the distance equal to the maximum relative movement permitted between the needle 11 and slider 12.

The invention envisages that the distance 23 will be substantially the same as the distance between the bottom dead centre point 18 and the straight tract 17 which follows the needle lifting track 16. In this way the slider 12 cannot begin to reascend when thrust by the needle 11 until the needle 11 has reached the end of the lifting track 16.

The distance 39 shown in the figures between the upper leveller cam 31 and the transition point 21 is envisaged in the invention as being greater than the greatest distance 124 between the upper edge of the butt 29 and the upper edge of the butt 30.

In this way the recall of the slider 12 by the needle 11 by means of the action of the protrusion 35 against the projection 37 takes place before the needle 11 itself engages the steep descent slope 220.

Indeed, in this way a sharp tug of a thrusting type applied to the slider 12 by the needle 11 by means of an impact of the projection 37 against the upper protrusion 35 is avoided, for with such an impact the projection 37 would undergo an excessively violent downwards thrust.

Instead, in this way the projection 37 and protrusion 35 engage each other before the butt 30 is engaged and is thrust downwards by the slope 220.

Sharp actuation of the slider 12, which would lead to serious shortcomings in the compound needle 10 in a short time with occurrence of wear or possibility of breakage, is thus obviated.

FIGS. 1*a* to 1*e* depict a normal jersey stitch operation. When a jersey stitch is formed, the needle 11 ascends along the profile 16 of cam 15, at the end of which it is raised to its maximum elevation by selector 40. The raised portion of the selector is shown in the figures. More particularly, one may see the needle 11 with the old loop D and the end of the slider 12 above the plane of the sinkers 38. The leveller cam 31 prevents the slider from being "thrown" upwards and therefore from being able to close the hook 28 of the needle. The needle then descends along track 120 and takes the yarn B from the feed A. The needle descends and the slider 12 is still above the plane of the sinkers.

Needle 11 descends one more time and begins to recall the slider (projections 35 and 37) shortly before meeting the steep track 220. At the end point 19, the needle has descended below the plane of the sinkers 38, thus forming a new loop C. The old loop D is disengaged from the needle. The sinker is in the "fully up" position in relation to the needle.

For tuck stitch operation shown in FIGS. 1*f* to 1*j*, needle 11 ascends along the profile 16 of the cam 15 but proceeds horizontally at the end of the profile since the selector 40 is lowered, which is depicted in this figure. Slider 12, which at its lower end abuts 36–37 against the needle, does not rise above the plane of the sinkers 38. In particular, it is possible to see the needle with old loop D and the end of the slider immediately below the plane of the sinkers 38. The needle proceeds taking the yarn B and descends along the profile 120; the needle further descends and the hook 28 is closed by the slider. The hook therefore takes both loops C and D without passing the former into the latter. Loop D is not disengaged from the needle because the slider has always remained low and permits the loop to engage hook 28. This method of formation of tuck stitches is described in more general terms, supra.

FIGS. 2*a* and 2*b* show a variant in which an intermediate leveller cam 32 for special types of stitch is envisaged for the purpose of avoiding the tugging of the slider 12.

This intermediate leveller cam 32 can be made resiliently sprung advantageously, as is shown in the figures. The purpose of this is to avoid damage or breakage in the event of impact of the slider butt 29 against the leveller cam 32.

Coordinated action of the upper leveller cam 31 and intermediate leveller cam 32 leads to the position of the slider 12 being kept constant until just before the recall of the slider 12 by the needle 11 in coincidence with the end portion of the gentle descent slope 120.

The final end 132 of the intermediate leveller cam is positioned, in the direction of lateral movement of the needle and slider in relation to the cam, immediately before the point where the needle sets the return movement of the slider in motion.

According to another variant shown in FIGS. 2*a* and 2*b* also, a pre-leveller cam 41 may be envisaged so as to prevent the slider 12 being pulled up by the needle 11 before the required tract. This pulling can occur through friction in coincidence with the reascent of the needle 11 along the lifting track 16.

The pre-leveller cam 41 may be rounded so as to join the upper leveller cam 31, as shown in the figures.

The leveller cam 31 and pre-leveller cam 41 may possibly be embodied in one single piece.

According to a further variant it is possible to envisage a track 45 to launch the slider 12, as shown with lines of dashes in FIG. 2*a*. This track 45 has the task of actuating the descent of the slider 12 before the latter is engaged by the needle 11 descending speedily.

In this way it is possible to obviate impacts between needle 11 and slider 12 during the steep descent of the needle 11.

I claim:

1. A process for operating and controlling compound needles each having a needle and a slider having a butt, said slider being moveable relative to said needle, the movement of said slider relative to said needle being restricted by appropriate abutment surfaces on said needle and said slider, said process comprising:

lifting said needle a distance sufficient to engage yarn but less than a distance equal to the maximum relative movement permitted between said needle and said slider, lifting said needle selectively another distance so as to bring, through the action of abutment between said needle and said slider, the upper end of said slider above the plane of knock-over of sinkers, and descending said needle along at least two successive slopes in a track with different descent inclinations wherein the second slope is steeper and recall of said slider by said needle begins before the needle itself is brought down again by said second slope.

2. The process of claim 1, further comprising interacting the butt of said slider, when said slider is lifted above said plane of knock-over of said sinkers to its highest level, with the upper flank of an intermediate leveller cam so that said needle, when lifted said another distance to its highest level by pusher means, in the course of its successive lowering by said descent track displaces said slider downwardly by means of an appropriate projection after having travelled along a descending track, a distance equal to the maximum relative movement permitted between said needle and said slider, the final end of the intermediate leveller cam being positioned, in the direction of lateral movement of the needle and slider in relation to the cam, immediately before the point where said needle sets in motion the return movement of said slider.

3. The process of claim 1, further comprising subjecting said slider to deceleration by a deceleration track acting on the butt of said slider in a position coordinated with at least the end part of a steep slope that abuts against said needle, the inclination of a controlled descent slope of said deceleration track being less than the inclination of said steep abutment slope, the maximum possible distance between the lower side of the butt of said slider and the upper side of the butt of said needle being substantially the same as, or a little greater than, the distance between the lowest point of the deceleration track and the lowest point of said steep abutment slope.

4. The process of claim 3, wherein the difference between the inclinations of the steep slope that abuts against said needle and of the controlled descent slope is between 8° and 20°.

5. The process of claim 1, wherein the descent of said slider is actuated by means that launch said slider at least along an initial track.

6. A stitch-forming cam in circular knitting machines, comprising at least track means for reascent of a needle, stitch forming cam means including (a) gentle slope means for descent of said needle and (b) steep stitch forming slope means, counter-cam means to establish the bottom dead center point for said needle, upper track means to control the travel of the butt of a slider from below, an upper leveller cam means to control the travel of the slider butt from above, and track means to decelerate the slider butt in a position coordinated with at least the end part of the steep slope that abuts against said needle, said track means being in cooperation with the upper track means, wherein the inclination of the controlled descent slope of the deceleration track is less than the inclination of the steep slope that abuts against said needle.

7. The stitch-forming cam of claim 6, wherein the maximum possible distance between the lower side of the butt of said slider and the upper side of the butt of the needle is substantially the same as, or a little greater than, the distance between the lowest point of the deceleration track and the lowest point of the steep abutment slope.

8. The stitch-forming cam of claim 6, wherein the difference in the inclination between the steep slope and the controlled descent slope is between 8° to 20°.

9. The stitch-forming cam of claim 8, wherein the maximum possible distance between the lower side of the butt of said slider and the upper side of the butt of the needle is substantially the same as, or a little greater than, the distance between the lowest point of the deceleration track and the lowest point of the steep abutment slope.

10. The stitch-forming cam of claim 6, further comprising intermediate leveller cam means.

11. The stitch-forming cam of claim 7, further comprising intermediate leveller cam means.

12. The stitch-forming cam of claim 8, further comprising intermediate leveller cam means.

13. The stitch-forming cam of claim 10, wherein said intermediate leveller cam means are resiliently sprung.

14. The stitch-forming cam of claim 6, further comprising slider-launching track means to actuate at least the initial phase of descent of said slider.

15. The stitch-forming cam of claim 7, further comprising slider-launching track means to actuate at least the initial phase of descent of said slider.

16. The stitch-forming cam of claim 8, further comprising slider-launching track means to actuate at least the initial phase of descent of said slider.

17. The stitch-forming cam of claim 9, further comprising slider-launching track means to actuate at least the initial phase of descent of said slider.

18. The stitch-forming cam of claim 10, further comprising slider-launching track means to actuate at least the initial phase of descent of said slider.

19. The stitch-forming cam of claim 11, further comprising slider-launching track means to actuate at least the initial phase of descent of said slider.

20. The stitch-forming cam of claim 12, further comprising slider-launching track means to actuate at least the initial phase of descent of said slider.

* * * * *